United States Patent [19]

Flindall et al.

[11] Patent Number: 4,912,592

[45] Date of Patent: Mar. 27, 1990

[54] GAS-FILLED SURGE ARRESTOR

[75] Inventors: John D. Flindall, Bath; Kelvin Loader, Ball, both of Great Britain

[73] Assignee: Cooper (UK) Limited, United Kingdom

[21] Appl. No.: 295,180

[22] PCT Filed: May 3, 1988

[86] PCT No.: PCT/GB88/00343

§ 371 Date: Feb. 24, 1989

§ 102(e) Date: Feb. 24, 1989

[87] PCT Pub. No.: WO88/08634

PCT Pub. Date: Nov. 3, 1988

[30] Foreign Application Priority Data

May 1, 1987 [GB] United Kingdom ..... 8710401

[51] Int. Cl.[4] ..... H02/ 9/06

[52] U.S. Cl. ..... 361/120; 361/124; 361/129; 361/130; 337/29; 337/32

[58] Field of Search ..... 361/111, 118–120, 361/124, 125, 130, 129; 337/28, 29, 31–33

[56] References Cited

U.S. PATENT DOCUMENTS

| | | | |
|---|---|---|---|
| 4,034,326 | 7/1977 | Hill et al. | 361/124 |
| 4,303,959 | 12/1981 | Roberts et al. | 361/124 |
| 4,573,100 | 2/1986 | Fasano | 361/119 |
| 4,649,456 | 3/1987 | DeLuca et al. | 361/119 |

FOREIGN PATENT DOCUMENTS 0060530 9/1982 European Pat. Off. .

*Primary Examiner*—Todd E. DeBoer

*Attorney, Agent, or Firm*—Biebel, French & Nauman

[57] ABSTRACT

A gas filled surge arestor has at least one external air back-up gap comprising two spaced electrodes(*7a*,2 or *7a*,3), one (*7a*) of which has at least one sharp edge or corner (9) adjacent the other electrode (2 or 3). The said one electrode (*7a*) is resiliently urged towards the other electrode and is coated with an insulating material (8) which prevents the two electrodes from being in direct contact and hence short circuiting. The arrangement is such that, although the sharp edge or corner (9) on said one electrode has a covering of insulating material, it is also separated from the other electrode by an air gap.

5 Claims, 1 Drawing Sheet

GAS-FILLED SURGE ARRESTOR

Figure 1:
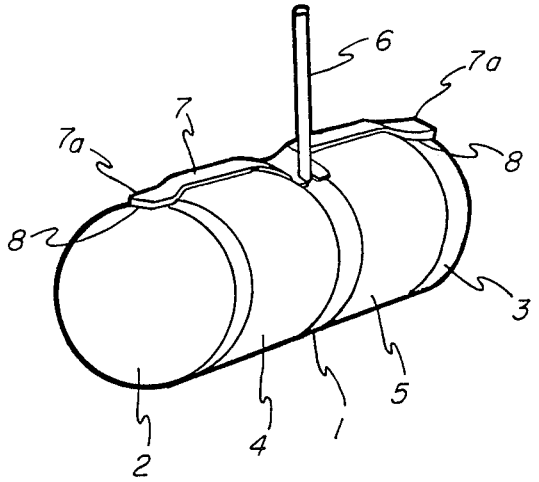

The present invention relates to gas-filled surge arrestors or gas discharge tubes comprising at least two electrodes defining a spark gap enclosed in a gas-filled housing. Such surge arrestors are designed to have a normal breakdown voltage which is repeatable about a predetermined value. However if the interior of the surge arrestor becomes vented to atmosphere, for example by sustained current conduction and consequent physical damage, then the breakdown voltage will become very much higher than the normal predetermined value and hence the surge arrestor is largely ineffective in performing its desired protective function. As an example a gas-filled surge arrestor designed to have a normal breakdown voltage of about 150V may, when its interior is vented to atmosphere, have an erratic breakdown voltage between 2–4 kV.

Various proposals have been made to overcome this disadvantage. One such proposal makes use of what is known in the art as "narrow-gap technology" in which the gap between the electrodes is made so small that the breakdown voltage of the surge arrestor is very similar whether operating normally or when its interior is vented to atmosphere. However this is a solution which is fraught with technical difficulties and is also expensive to achieve. A further proposal is to provide an external air back-up gap connected in parallel with the electrodes defining the gas discharge gap within the housing of the surge arrestor. However again it is found that the breakdown voltage of such a back-up air gap is higher than is desirable and a repeatable back-up gap breakdown voltage is difficult to attain.

The present invention seeks to provide a gas-filled surge arrestor having an external air back-up gap which has both an acceptable value of breakdown voltage and a repeatable breakdown voltage.

According to the present invention a gas-filled surge arrestor is provided with an external air back-up gap comprising two spaced electrodes of which one has a sharp edge or corner adjacent the other electrode. The said one electrode may be coated with an insulating material at least over the region defining the sharp edge or corner.

According to a preferred form of the invention, said one electrode is positively urged towards the other electrode and is coated with an insulating material which prevents the two electrodes from being in direct contact and hence short-circuiting together. In this way the spacing between the two electrodes is defined to some extent by the insulation between them. However, the electrodes are so shaped and arranged in relation to each other that although the sharp edge of corner on said one electrode has a covering of insulating material it is also separated from the other electrode by an air gap. According to one embodiment of the invention, said one electrode is planar and defines at least one sharp corner and said other electrode defines a curved surface.

According to a further embodiment of the invention, said one electrode is made of a spring material so that it is urged towards said other electrode and the arrangement is such that if the surge arrestor becomes overheated the insulating material will soften or decompose, thereby allowing the two electrodes to come into contact and short circuit the gas discharge gap within the surge arrestor housing. In this way the structure of the back-up gap also functions as a fail-safe device for the surge arrestor.

The invention therefore also provides a gas-filled surge arrestor having an external air back-up gap connected in parallel with the electrodes defining the gas discharge gap within the housing of the arrestor wherein said back up gap is also constructed to function as a fail-safe device which short circuits the gas discharge electrodes in the event of overheating of the surge arrestor.

In the arrangements according to the present invention one of the electrodes of the back-up gap may also comprise one of the gas discharge electrodes of the surge arrestor.

Figure 2A:
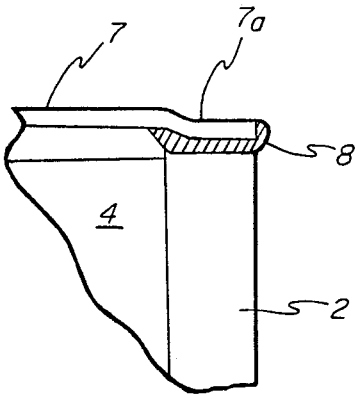
Figure 2B:
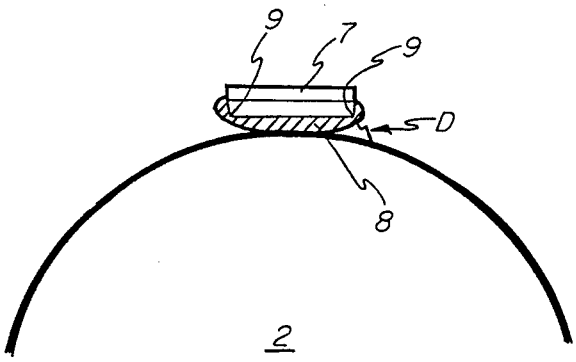

The invention will now be further described, by way of example, with reference to the accompanying drawings, in which:

FIG. 1 is a perspective view of one embodiment of gas-filled surge arrestor according to the invention; and FIGS. 2*a* and 2*b* are partial side and end views to a larger scale showing in detail the structure of the external air back-up gap.

Referring to the drawings a gas-filled surge arrestor or gas discharge tube which has two spark gaps comprises a central electrode 1 and two end electrodes 2,3. The electrodes are held in spaced relationship to define the desired gaps by means of annular ceramic members 4 and 5. The electrodes are secured to the ceramic members to define a housing filled with an appropriate gas to assist in the correct functioning of the surge arrestor as is well known in the art. The central electrode 1, which often forms an earth connection, is provided with a terminal pin 6. A spring metal strip 7 extends along the body of the surge arrestor and is connected at its central region to the terminal pin 6. By virtue of the shaping and spring tension in the strip its ends 7*a* are urged towards the adjacent surface of the electrodes 2 and 3 but are prevented from electrical contact with these electrodes by virtue of a coating of insulating material 8. This can be seen clearly in FIGS. 2*a* and 2*b*. The strip 7 may be made of beryllium copper and the insulating material 8 may be a polyurethane varnish. In practice the insulating coating 8 may have a thickness of some tens of microns, for example 20–40 microns, but as can be seen in FIG. 2*b* the thickness of the coating is much reduced at the sharp edges or corners 9 of the strip.

It has surprisingly been found that in the event of the interior of the surge arrestor becoming vented to atmosphere, an air gap breakdown D occurs between the sharp edge or corner 9 and the adjacent surface of the electrode 2 (or 3) at a very repeatable value and an acceptably low voltage level. For example, for surge arrestors designed to operate with a normal breakdown voltage within the range 150–250 volts, 210–310 volts or 260–600 volts, the air gap breakdown repeatably occurred at a value of 700–800 volts. It is believed that this low value of air gap breakdown and its repeatability is probably due to the high degree of ionisation caused by the geometry of the gap and the sharp edge or corner 9 formed by the strip 7. The coating of insulating material over the sharp edge or corner is optional; in other words the region 9 could be exposed metal.

In this embodiment, overheating of the surge arrestor will cause thermal decomposition of the polyurethane varnish thereby allowing the ends 7*a* of the strip 7 to move into electrical contact with the electrodes 2,3; so forming a fail-safe device which short circuits the internal spark gaps of the surge arrestor. Moreover, this fail-safe mechanism will also operate to short circuit the surge arrestor in the case where continual discharges D across the back-up air gap cause the insulating material 8 to be removed due to the overheating caused by prolonged electrical arcing. A similar situation will again occur when the back-up air gap is subjected to a high a.c. voltage, e.g. of the order of 1000V rms of varying currents such that the heat generated by the arcing will be sufficient to vaporize the insulating material 8.

Clearly other embodiments of the invention are possible. Thus, the two electrodes of the back-up air gap may both be rigid and both may be provided with a sharp corner or edge. Other insulating materials may be used as are commonly employed in the art. The invention is obviously applicable to surge arrestors having only a single spark gap as well as those comprising more than two spark gaps.

We claim:

1. A gas-filled surge arrestor comprising:

a housing filled with a gas;

at least two spaced electrodes defining a gas discharge gap within said housing; and at least two spaced electrodes defining an air back-up gap external of said housing;

wherein one electrode defining an air back-up gap has at least one sharp edge or corner adjacent the other electrode of said air back-up gap and a coating of an insulating material over at least the region defining said at least one sharp edge or corner.

2. A gas-filled surge arrestor according to claim 1 wherein said one air back-up gap electrode is resiliently urged towards the other air back-up gap electrode and the insulating material prevents the two air back-up electrodes from being in direct contact and hence short circuiting, said electrodes being so sharped and arranged in relation to each other that, although the or each sharp edge or corner of said one electrode has a covering of insulating material, it is also separated from said other electrode by an air gap.

3. A gap-filled surge arrestor according to claim 2, wherein said one air back-up gap electrode is planar and defines at least one sharp edge or corner and said other air back-up gap electrode has a juxtaposed curved surface.

4. A gas-filled surge arrestor according to claim 2, wherein said one air back-up gap electrode is made of resilient material so that it is urged towards said other air back-up gap electrode and the arrangement is such that, if the surge arrestor becomes overheated, the insulating material softens or decomposes, thereby allowing the two electrodes to come into contact and short circuit the gas discharge gap.

5. A gas-filled surge arrestor comprising:

a housing filled with gas;

at least two spaced electrodes defining a gas discharge gap within said housing; and at least two spaced electrodes defining an air back-up located externally of said housing and in parallel with said electrodes defining the gas discharge gap;

said air back-up gap being also constructed to function as a fail-safe device which short-circuits the gas discharge electrodes in the event of overheating of the surge arrestor; wherein one electrode defining said air back-up gap has at least one sharp edge or corner adjacent the other electrode defining the air back-up; and wherein said one back-up gap electrode is resiliently urged towards said other air back-up gap electrode and said one electrode is coated with a thermally-softenable or decomposable insulating material at least over the region defining said at least one sharp edge or corner, said insulating material being arranged to prevent the two air back-up gap electrodes from being in direct contact and hence short-circuiting unless the material softens or decomposes due to the surge arrestor overheating thereby allowing said two air back-up gap electrodes to come into contact and short circuit the gas discharge gap, the air back-up gap electrodes being so shaped and arranged in relation to each other that, although the or each sharp edge or corner of said one electrode has a coating of insulating material, it is also separated from said other electrode by an air gap.

* * * * *